US012281488B2

(12) United States Patent
Gutierrez

(10) Patent No.: US 12,281,488 B2
(45) Date of Patent: Apr. 22, 2025

(54) FENCE BRACKET KIT

(71) Applicant: Camilo Gutierrez, Long Beach, CA (US)

(72) Inventor: Camilo Gutierrez, Long Beach, CA (US)

( * ) Notice: Subject to any disclaimer, the term of this patent is extended or adjusted under 35 U.S.C. 154(b) by 438 days.

(21) Appl. No.: 17/946,138

(22) Filed: Sep. 16, 2022

(65) Prior Publication Data

US 2024/0093529 A1 Mar. 21, 2024

(51) Int. Cl.
*E04H 17/14* (2006.01)

(52) U.S. Cl.
CPC ..... *E04H 17/146* (2021.01)

(58) Field of Classification Search
CPC . E04H 17/14; E04H 17/1413; E04H 17/1447; E04H 17/1452; E04H 17/1473; E04H 17/1488
See application file for complete search history.

(56) References Cited

U.S. PATENT DOCUMENTS 5,192,056 A * 3/1993 Espinueva ..... E04H 17/1417 256/65.06
5,938,184 A * 8/1999 DeSouza ..... E04H 17/1417 256/65.06
5,961,242 A 10/1999 Leone
6,290,214 B1 * 9/2001 DeSouza ..... E04H 17/1413 52/712
8,834,057 B2 * 9/2014 Adams, Jr. ..... F16B 7/0493 403/233
10,030,408 B2 * 7/2018 Crandall ..... E04H 17/1413
D869,936 S * 12/2019 Smith ..... D8/349
10,597,899 B2 * 3/2020 Crandall ..... E04H 17/1447
10,655,359 B2 5/2020 Hemingway
10,697,198 B2 * 6/2020 Crandall ..... E04H 17/1417
10,760,298 B2 * 9/2020 Crandall ..... E04H 17/1417
10,961,743 B2 * 3/2021 Crandall ..... E04H 17/1447
D972,393 S * 12/2022 Karlsson ..... D8/349
11,891,831 B1 * 2/2024 Hudson ..... E04H 17/16
11,988,010 B2 * 5/2024 Crandall ..... E04H 17/1452
2006/0091372 A1 * 5/2006 Rosian ..... E04F 11/1817 256/65.01
2012/0080574 A1 4/2012 Mills
2012/0138758 A1 * 6/2012 Graber ..... E04H 17/1417 248/221.11

(Continued)

FOREIGN PATENT DOCUMENTS

CA 2322610 A1 * 4/2002 ..... E04H 17/1421
CA 2717783 4/2012

(Continued)

*Primary Examiner* — Jonathan P Masinick

(57) ABSTRACT

A fence bracket kit for aligning and attaching posts and rails for the construction of a fence includes a sidewall bracket fits around a sidewall post and aligns a pair of sidewall rails such that a pair of sidewall portions of a fence are aligned. A corner bracket fits against a corner of a corner post and aligns a pair of corner rails perpendicular to each other, thereby facilitating the perpendicular alignment of a first corner portion and a second corner portion of the fence. A first end bracket and a second end bracket couple to an end rail at the end of a fence. Each of the sidewall bracket, the corner bracket, the first end bracket, and the second end bracket are configured for mounting a light emitter.

13 Claims, 6 Drawing Sheets

(56) References Cited

U.S. PATENT DOCUMENTS

| | | | |
|---|---|---|---|
| 2012/0145983 | A1 | 6/2012 | Rosicki |
| 2015/0197960 | A1 | 7/2015 | Woods |
| 2019/0316378 | A1 | 10/2019 | Wall |

FOREIGN PATENT DOCUMENTS

| | | | | | | |
|---|---|---|---|---|---|---|
| CH | 584829 | A5 | * | 2/1977 | | |
| DE | 4039657 | A1 | * | 6/1992 | | |
| DE | 102007023501 | A1 | * | 11/2008 | ..... | E04H 17/1421 |
| FR | 2449768 | A1 | * | 9/1980 | | |
| GB | 2224048 | A | * | 4/1990 | ..... | E04H 17/1434 |
| GB | 2259923 | A | * | 3/1993 | ..... | E04H 12/2269 |

* cited by examiner

FENCE BRACKET KIT

BACKGROUND OF THE INVENTION

(1) Field of the Invention

The disclosure relates to fence bracket kits and more particularly pertains to a new fence bracket kit for aligning and attaching posts and rails for the construction of a fence.

(2) Description of Related Art Including Information Disclosed Under 37 CFR 1.97 and 1.98

The prior art relates to fence bracket kits, systems, and devices which facilitate the construction of a fence. The prior art discloses a variety of means for facilitating the construction of a fence via the use of brackets. However, the prior art does not disclose a bracket kit, the pieces of which incorporate a first bracket which partially surrounds a post and aligns a pair of rails leading to the post by supporting the pair of rails from below and aligning them with a pair of front portions, a second bracket which abuts a corner of a corner post and angles another pair of rails leading to the corner post at a right angle by supporting the other pair of rails from below and aligning them with a second pair of front portions, and two end brackets which are placed at the end of a rail at the end of the fence, and wherein each of these brackets further provides bendable mounting tabs for mounting a solar power lamp or the like for illumination near the fence.

BRIEF SUMMARY OF THE INVENTION

An embodiment of the disclosure meets the needs presented above by generally comprising a sidewall bracket fits around a sidewall post and aligns a pair of sidewall rails such that a pair of sidewall portions of a fence are aligned. A corner bracket fits against a corner of a corner post and aligns a pair of corner rails perpendicular to each other, thereby facilitating the perpendicular alignment of a first corner portion and a second corner portion of the fence. A first end bracket and a second end bracket couple to an end rail at the end of a fence. Each of the sidewall bracket, the corner bracket, the first end bracket, and the second end bracket are configured for mounting a light emitter. There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
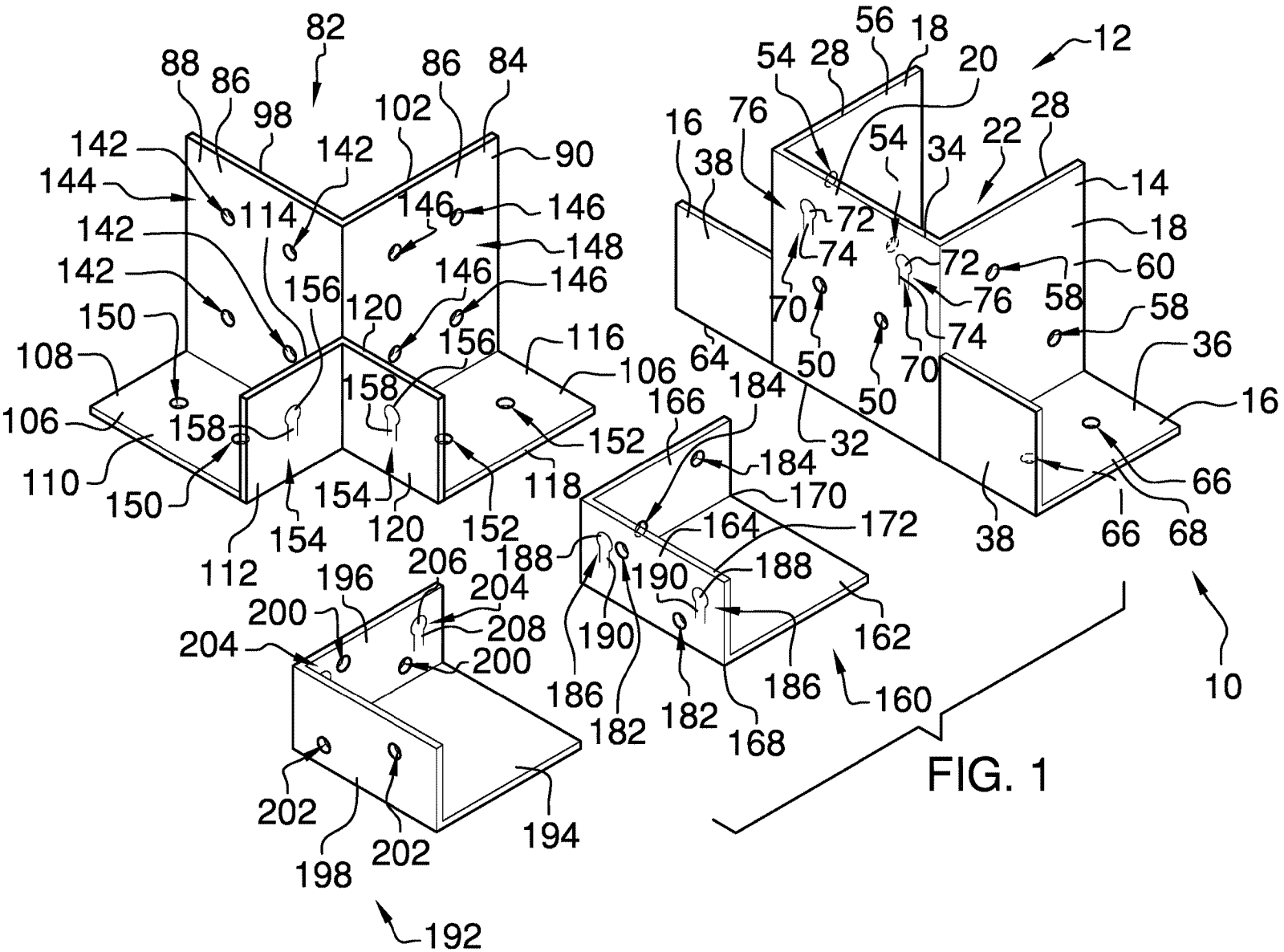
FIG. 1 is a perspective view of a fence bracket kit according to an embodiment of the disclosure.
Figure 2:
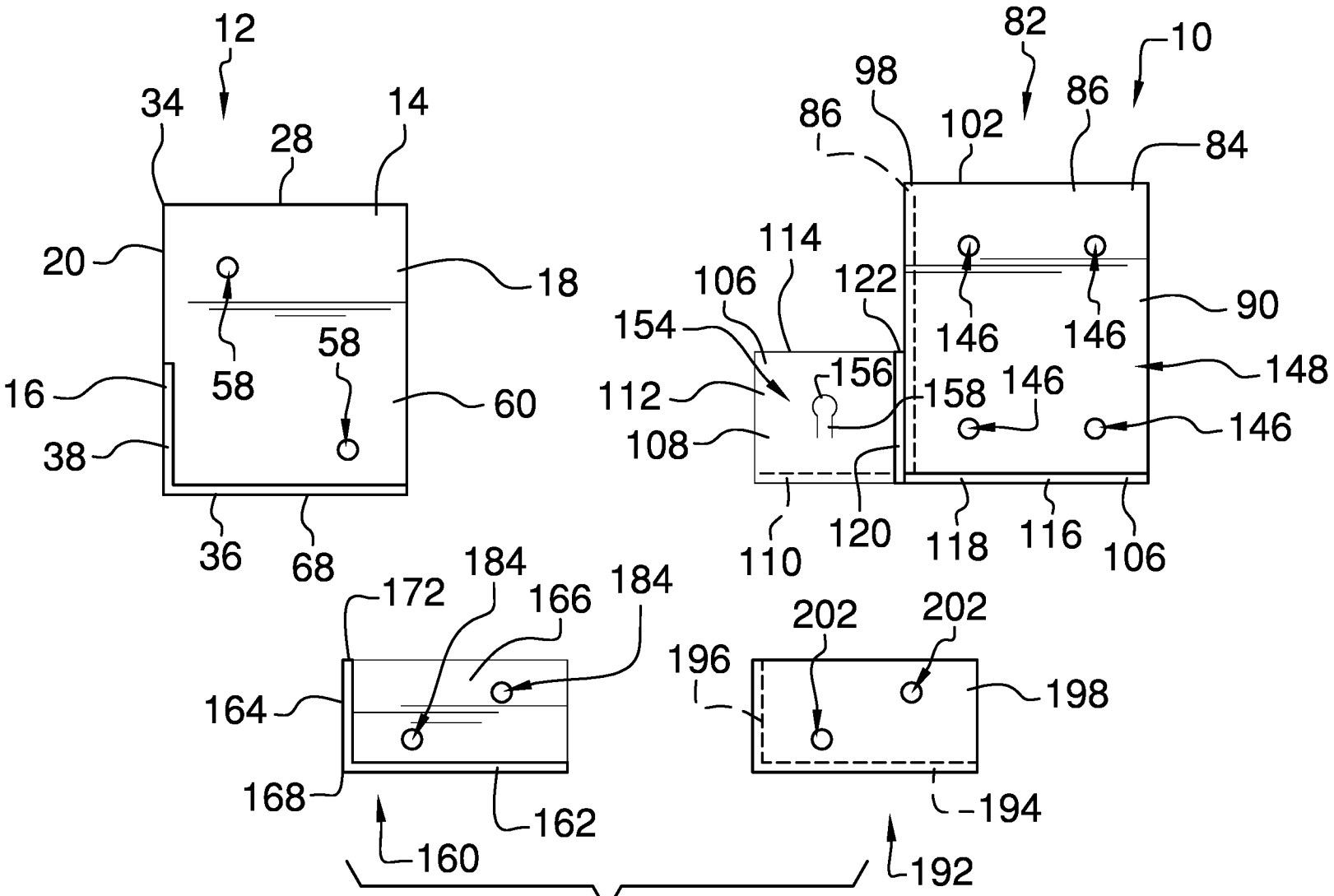
FIG. 2 is a side view of an embodiment of the disclosure.
Figure 3:
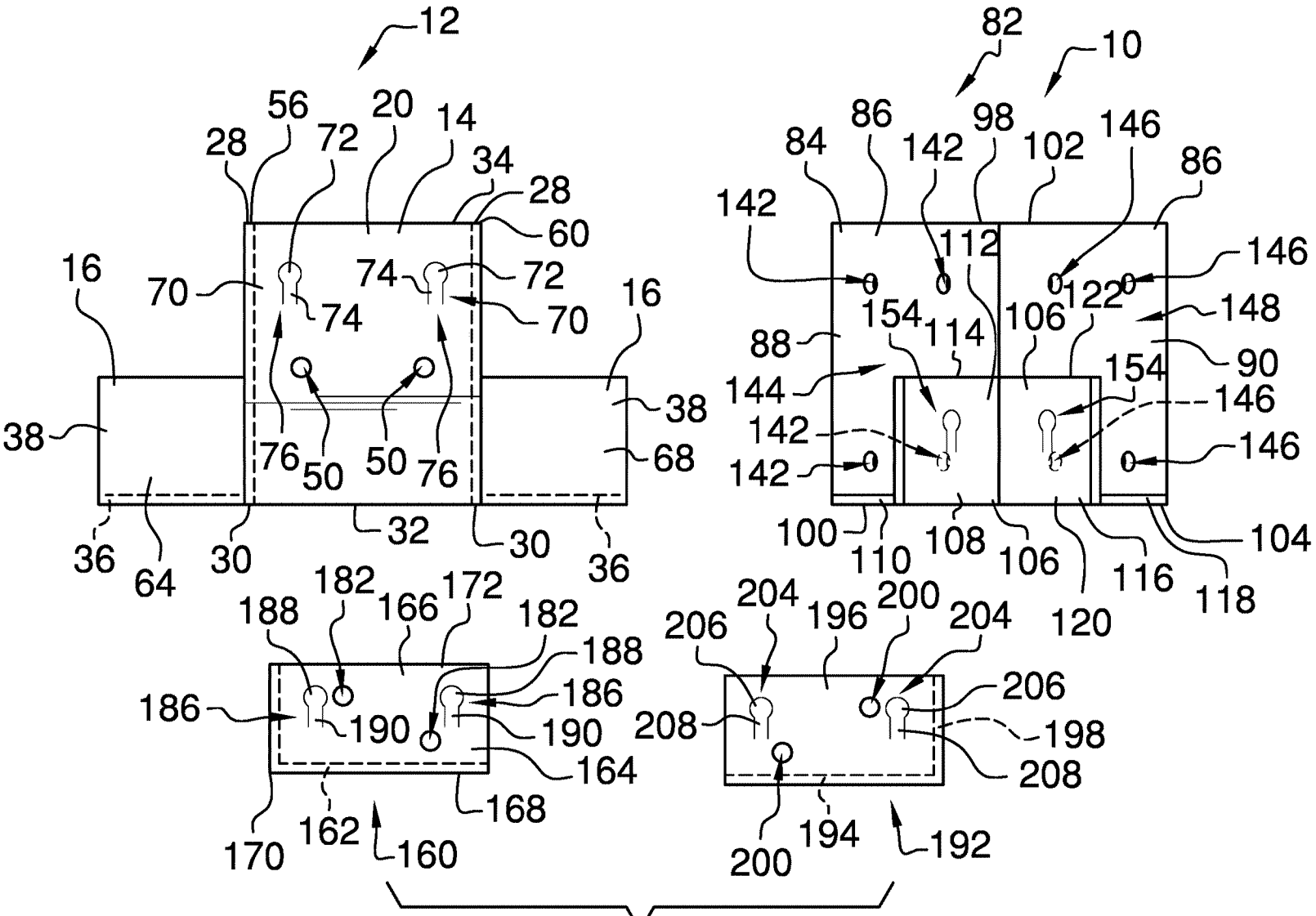
FIG. 3 is a front view of an embodiment of the disclosure.
Figure 4:
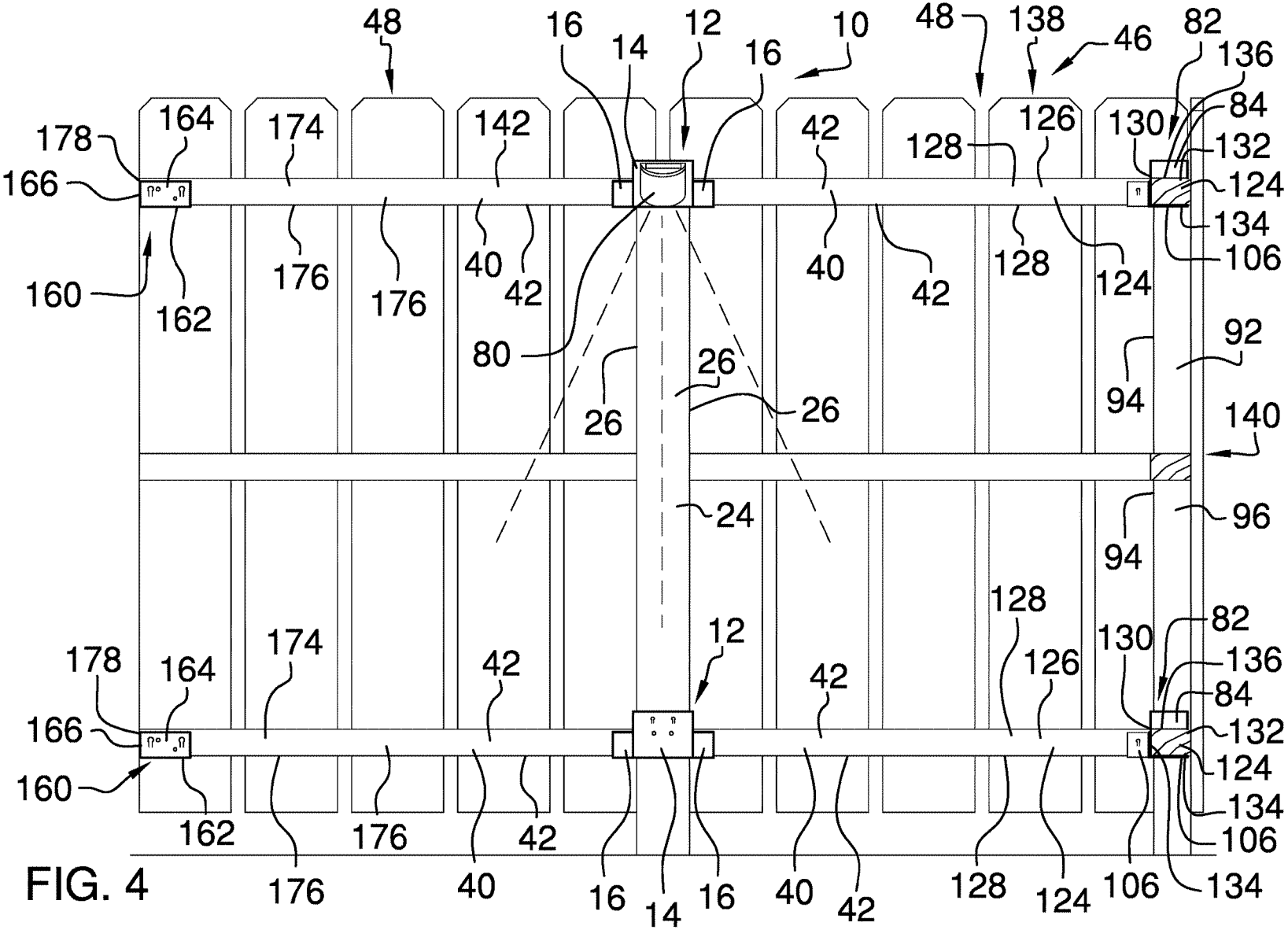
FIG. 4 is an in-use view of an embodiment of the disclosure.
Figure 5:
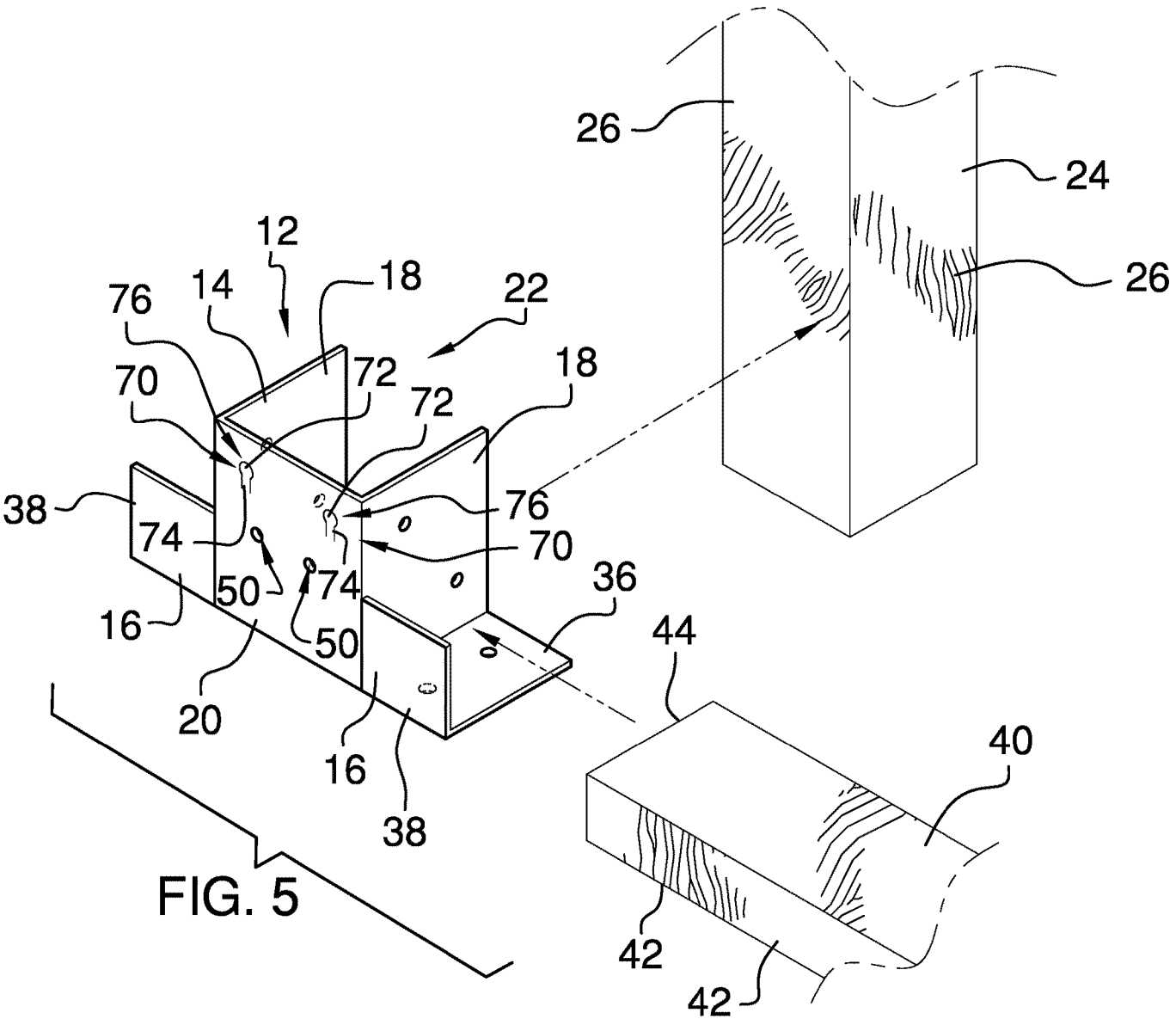
FIG. 5 is an exploded in-use view of a sidewall bracket of an embodiment of the disclosure.
Figure 6:
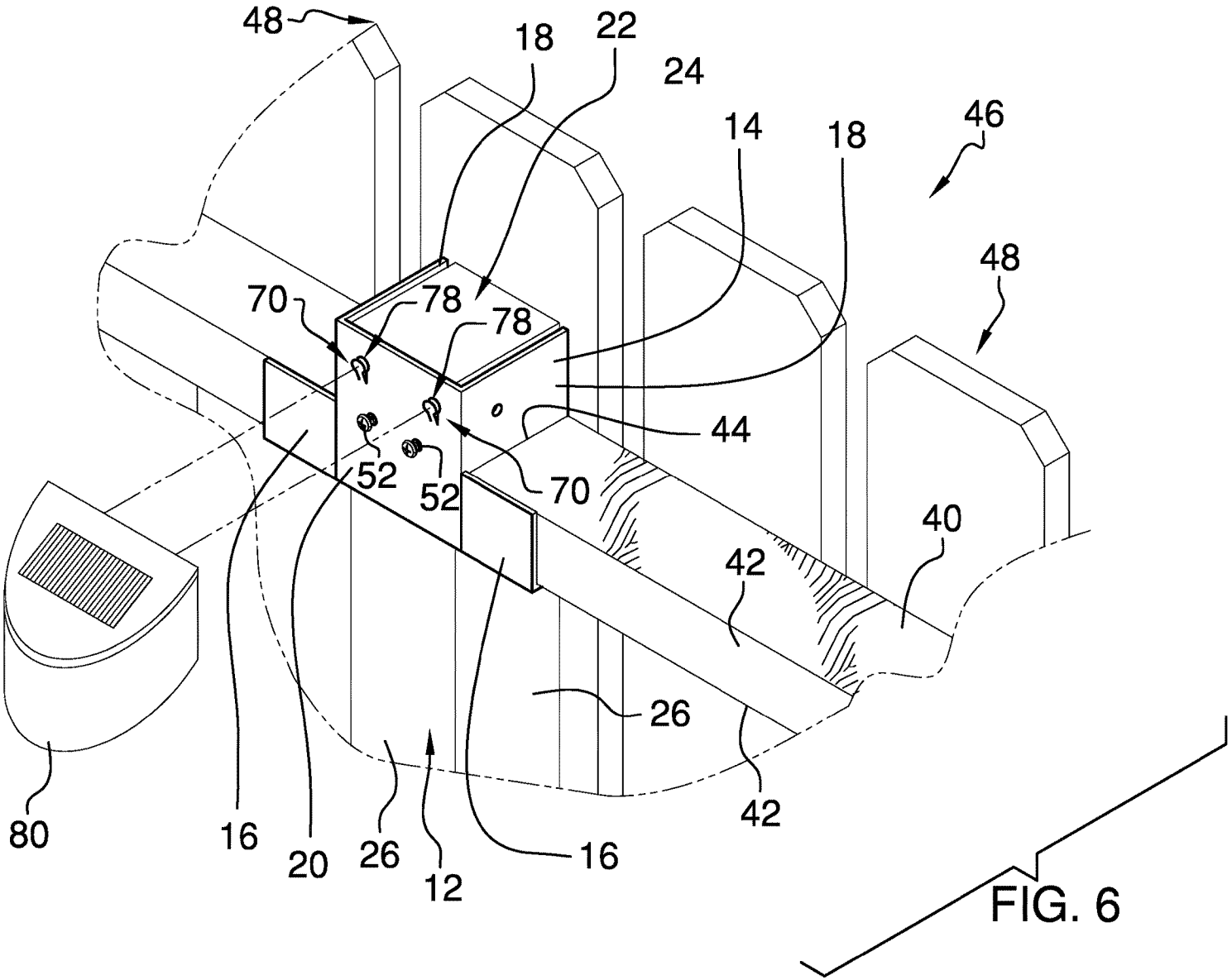
FIG. 6 is a detail in-use view of a sidewall bracket of an embodiment of the disclosure.

With reference now to the drawings, and in particular to FIGS. 1 through 6 thereof, a new fence bracket kit embodying the principles and concepts of an embodiment of the disclosure and generally designated by the reference numeral 10 will be described.

As best illustrated in FIGS. 1 through 6, the fence bracket kit 10 generally comprises a sidewall bracket 12. The sidewall bracket 12 includes a central member 14 that is U-shaped. The central member 14 has a pair of side portions 18 and a front portion 20 extending perpendicularly between the pair of side portions 18 of the central member 14. The central member 14 defines a channel 22 between the pair of side portions 18 of the central member 14 and adjacent the front portion 20 of the central member 14. Each of the front portion 20 of the central member 14 and each side portion 18 of the central member 14 is planar and rectangular. The central member 14 is configured for laterally receiving a sidewall post 24 within the channel 22 such that each of the front portion 20 of the central member 14 and each side portion 18 of the central member 14 abut an associated side 26 of a plurality of sides 26 of the sidewall post 24. Each side portion 18 of the central member 14 has a top end 28 and a bottom end 30. The front portion 20 of the central member 14 has a bottom end 32 extending between the bottom end 30 of each side portion 18 of the central member 14 and a top end 34 extending between the top end 28 of each side portion 18 of the central member 14.

The sidewall bracket 12 also includes a pair of sidewall wing members 16, each of which is coupled to and extends perpendicularly from an associated side portion 18 of the pair of side portions 18 of the central member 14 away from the channel 22. Each sidewall wing member 16 is L-shaped. Each sidewall wing member 16 has a bottom portion 36 extending from the bottom end 30 of the associated side portion 18 of the central member 14 and a front portion 38 extending perpendicularly from the bottom portion 36 of the sidewall wing member 16 and aligning with the front portion 20 of the central member 14. Each of the bottom portion 36 of each sidewall wing member 16 and the front portion 38 of each sidewall wing member 16 is planar and rectangular. Each sidewall wing member 16 is configured for aligning an associated sidewall rail 40 of a pair of sidewall rails 40 such that each of a pair of sides 42 of the associated sidewall rail 40 abuts an associated one of each of the bottom portion 36 of the sidewall wing member 16 and the front portion 38 of the sidewall wing member 16 and an end 44 of the associated sidewall rail 40 abuts the associated side portion 18 of the central member 14. The pair of sidewall wing members 16 is thereby configured for aligning the pair of sidewall rails 40 with each other to facilitate aligning two adjacent sidewall portions 48 of a fence 46 during construction of the fence 46.

A pair of front central holes 50 extends through the front portion 20 of the central member 14 and is aligned parallel with the bottom end 32 of the front portion 20 of the central member 14. Each front central hole 50 is configured for facilitating coupling the central member 14 to the sidewall post 24 by receiving an associated threaded fastener 52 of a plurality of threaded fasteners 52 therethrough. A pair of first side holes 54 extends through a first side portion 56 of the pair of side portions 18 of the central member 14. One of the pair of first side holes 54 is positioned closer to the top end 28 of the first side portion 56 of the central member 14 and closer to the front portion 20 of the central member 14 than another of the pair of first side holes 54. Each first side hole 54 is configured for facilitating coupling the central member 14 to the sidewall post 24 by receiving an associated threaded fastener 52 of the plurality of threaded fasteners 52 therethrough. A pair of second side holes 58 extends through a second side portion 60 18 of the pair of side portions 18 of the central member 14. One of the pair of second side holes 58 is positioned closer to the top end 28 of the second side portion 60 18 of the central member 14 and closer to the front portion 20 of the central member 14 than another of the pair of second side holes 58. Each second side hole 58 is configured for facilitating coupling the central member 14 to the sidewall post 24 by receiving an associated threaded fastener 52 of the plurality of threaded fasteners 52 therethrough.

A pair of first sidewall wing holes 62 extends through the bottom portion 36 of a first sidewall wing member 64 of the pair of sidewall wing members 16 and is aligned perpendicular to the front portion 38 of the first sidewall wing member 64. Each first sidewall wing hole 62 is configured for facilitating coupling the central member 14 to the associated sidewall rail 40 by receiving an associated threaded fastener 52 of the plurality of threaded fasteners 52 therethrough. A pair of second sidewall wing holes 66 extends through the bottom portion 36 of a second sidewall wing member 68 of the pair of sidewall wing members 16 and is aligned perpendicular to the front portion 38 of the second sidewall wing member 68. Each second sidewall wing hole 66 is configured for facilitating coupling the central member 14 to the associated sidewall rail 40 by receiving an associated threaded fastener 52 of the plurality of threaded fasteners 52 therethrough.

Each of a pair of sidewall mounting tabs 70 has a bulb portion 72 and a neck portion 74, wherein the neck portion 74 couples the bulb portion 72 to the front portion 20 of the central member 14. Each sidewall mounting tab 70 is bendably movable between an undeployed position 76 and a deployed position 78 and is coplanar with the front portion 20 of the central member 14 when in the undeployed position 76. The bulb portion 72 of each sidewall mounting tab 70 is positioned between the neck portion 74 and the top end of the front portion 20 of the central member 14 when each sidewall mounting tab 70 is in the undeployed position 76. Each sidewall mounting tab 70 extends away from the channel 22 when in the deployed position 78 and is configured for inserting into an associated mounting hole of a pair of mounting holes of a light emitter 80, thereby securing the light emitter 80 to the sidewall bracket 12, when in the deployed position 78.

A corner bracket 82 includes an L-shaped corner member 84 that has a pair of corner portions 86. A first corner portion 88 of the pair of corner portions 86 extends perpendicularly from a second corner portion 90 of the pair of corner portions 86. The first corner portion 88 of the corner member 84 is equal in size and shape to the second corner portion 90. Each corner portion 86 is planar and rectangular. The corner member 84 is configured for abutting a corner 94 of a corner post 92 such that each corner portion 86 abuts an associated side 96 of a plurality of sides 96 of the corner post 92. The first corner portion 88 has a top end 98 and a bottom end 100, and the second corner portion 90 has a top end 102 extending perpendicularly from the top end 98 of the first corner portion 88 and a bottom end 104 extending perpendicularly from the bottom end 100 of the first corner portion 88.

The corner bracket 82 also includes a pair of L-shaped corner wing members 106, each of which extends perpendicularly from an associated corner portion 86 of the pair of corner portions 86. A first corner wing member 108 of the pair of corner wing members 106 has a bottom portion 110 extending perpendicularly from the bottom end 100 of the first corner portion 88 and a front portion 112 extending perpendicularly from the bottom portion 110 of the first corner wing member 108 and aligning with the second corner portion 90. The front portion 112 of the first corner wing member 108 has a top end 114 facing away from the bottom portion 110 of the first corner wing member 108. A second corner wing member 116 of the pair of corner wing members 106 has a bottom portion 118 extending perpendicularly from the bottom end 104 of the second corner portion 90 and a front portion 120 extending perpendicularly from the bottom portion 118 of the second corner wing member 116 and aligning with the first corner portion 88. The front portion 120 of the second corner wing member 116 has a top end 122 facing away from the bottom portion 118 of the second corner wing member 116.

The first corner wing member 108 is configured for aligning a first corner rail 126 of a pair of corner rails 124 such that each of a pair of sides 126 of the first corner rail 126 abuts an associated one of each of the bottom portion 110 of the first corner wing member 108 and the front portion 112 of the first corner wing member 108 and an end 130 of the first corner rail 126 abuts the first corner portion 88. The second corner wing member 116 is configured for aligning a second corner rail 132 of a pair of corner rails 124 such that each of a pair of sides 134 of the second corner rail 132 abuts an associated one of each of the bottom portion 118 of the second corner wing member 116 and the front portion 120 of the second corner wing member 116 and an end 136 of the second corner rail 132 abuts the second corner portion 90. The pair of corner wing members 106 is configured for angling the second corner rail 132 perpendicular to the first corner rail 126 to facilitate angling a second corner portion 140 of the fence 46 perpendicular to a first corner portion 138 of the fence 46 during construction of the fence 46.

A plurality of first corner holes 142 extends through the first corner portion 88. The plurality of first corner holes 142 is positioned to define a first rectangle 144 that is concentric with the first corner portion 88. Each first corner hole 142 is configured for facilitating coupling the corner member 84 to the corner post 92 by receiving an associated threaded fastener 52 of the plurality of threaded fasteners 52 therethrough. A plurality of second corner holes 146 extends through the second corner portion 90. The plurality of second corner holes 146 is positioned to define a second rectangle 148 that is concentric with the second corner portion 90. Each second corner hole 146 is configured for facilitating coupling the corner member 84 to the corner post 92 by receiving an associated threaded fastener 52 of the plurality of threaded fasteners 52 therethrough. A pair of first corner wing holes 150 extends through the bottom portion 110 of the first corner wing member 108 and is aligned perpendicular to the front portion 112 of the first corner wing member 108. Each first corner wing hole 150 is configured for facilitating coupling the corner member 84 to the first corner rail 126 by receiving an associated threaded fastener 52 of the plurality of threaded fasteners 52 therethrough. A pair of second corner wing holes 152 extends through the bottom portion 118 of the second corner wing member 116 and is aligned perpendicular to the front portion 120 of the second corner wing member 116. Each second corner wing hole 152 is configured for facilitating coupling the corner member 84 to the second corner rail 132 by receiving an associated threaded fastener 52 of the plurality of threaded fasteners 52 therethrough.

Each of a pair of corner mounting tabs 154 has a bulb portion 156 and a neck portion 158, wherein the neck portion 158 of each corner mounting tab 154 couples the bulb portion 156 of each corner mounting tab 154 to the front portion of an associated corner wing member 106. Each corner mounting tab 154 is bendably movable between an undeployed position and a deployed position and is coplanar with the front portion of the associated corner wing member 106 when in the undeployed position. The bulb portion 156 of each corner mounting tab 154 is positioned between the neck portion 158 and the top end of the front portion of the associated corner wing member 106 when each corner mounting tab 154 is in the undeployed position. Each corner mounting tab 154 extends away from the associated corner wing member 106 when in the deployed position and is configured for inserting into an associated mounting hole of the pair of mounting holes of the light emitter 80, thereby securing the light emitter 80 to the sidewall bracket, when in the deployed position.

A first end bracket 160 includes a first base portion 162, a first front flange 164, and a first side flange 166. The first base portion 162 is planar and square and has a front edge 168 and a side edge 170 adjacent to the front edge 162 of the first base portion 162. A first front flange 164 is planar and rectangular and extends from the front edge 162 of the first base portion 162. The first front flange 164 has a top end 172 facing away from the first base portion 162. A first side flange 166 is planar and rectangular and extends from the side edge 170 of the first base portion 162. The first end bracket 160 is configured for aligning an end rail 174 such that each of a pair of sides 176 of the end rail 174 abuts an associated one of each of the first base portion 162 and the first front flange 164 and a first end 178 of the end rail 174 abuts the first side flange 166.

A pair of first front holes 182 extends through the first front flange 164. One of the pair of first front holes 182 is positioned farther from the first base portion 162 and closer to the first side flange 166 than another of the pair of first front holes 182. Each first front hole 182 is configured for facilitating coupling the first end bracket 160 to the end rail 174 by receiving an associated threaded fastener 52 of the plurality of threaded fasteners 52 therethrough. A pair of first side holes 184 extends through the first side flange 166. One of the pair of first side holes 184 is positioned farther from the first base portion 162 and farther from the first front flange 164 than another of the pair of first side holes 184. Each first side hole 184 is configured for facilitating coupling the first end bracket 160 to the first end of an end rail 174 by receiving an associated threaded fastener 52 of the plurality of threaded fasteners 52 therethrough.

Each of a pair of first end mounting tabs 186 has a bulb portion 188 and a neck portion 190, wherein the neck portion 190 of each first end mounting tab 186 couples the bulb portion 188 of each first end mounting tab 186 to the first front flange 164. Each first end mounting tab 186 is bendably movable between an undeployed position and a deployed position and is coplanar with the first front flange 164 when in the undeployed position. The bulb portion 188 of each first end mounting tab 186 is positioned between the neck portion 190 and the top end 172 of the first front flange 164 when each first end mounting tab 186 is in the undeployed position. Each first end mounting tab 186 extends away from the first front flange 164 when in the deployed position and is configured for inserting into an associated mounting hole of the pair of mounting holes of the light emitter 80, thereby securing the light emitter 80 to the first end bracket 160, when in the deployed position.

A second end bracket 192 includes a second base portion 194, a second front flange 196, and a second side flange 198. A second base portion 194 is planar and square and has a front edge and a side edge adjacent to the front edge of the second base portion 194. A second front flange 196 is planar and rectangular and extends from the front edge of the second base portion 194. The second front flange 196 has a top end facing away from the second base portion 194. A second side flange 198 is planar and rectangular and extends from the side edge of the second base portion 194. The second end bracket 192 is configured for aligning the end rail 174 such that each of the pair of sides 176 of the end rail 174 abuts an associated one of each of the second base portion 194 and the second front flange 196 and a second end 180 of the end rail 174 abuts the second side flange 198.

A pair of second front holes 200 extends through the second front flange 196. One of the pair of second front holes 200 is positioned farther from the second base portion 194 and closer to the second side flange 198 than another of the pair of second front holes 200. Each second front hole 200 is configured for facilitating coupling the second end bracket 192 to the end rail 174 by receiving an associated threaded fastener 52 of the plurality of threaded fasteners 52 therethrough. A pair of second side holes 202 extends through the second side flange 198. One of the pair of second side holes 202 is positioned farther from the second base portion 194 and farther from the second front flange 196 than another of the pair of second side holes 202. Each second side hole 202 is configured for facilitating coupling the second end bracket 192 to the second end of an end rail 174 by receiving an associated threaded fastener 52 of the plurality of threaded fasteners 52 therethrough.

Each of a pair of second end mounting tabs 204 has a bult portion 206 and a neck portion 208, wherein the neck portion 208 of each second end mounting tab 204 couples the bult portion 206 of each second end mounting tab 204 to the second front flange 196. Each second end mounting tab 204 is bendably movable between an undeployed position and a deployed position and is coplanar with the second front flange 196 when in the undeployed position. The bult portion 206 of each second end mounting tab 204 is positioned between the neck portion 208 and the top end of the second front flange 196 when each second end mounting tab 204 is in the undeployed position. Each second end mounting tab 204 extends away from the second front flange 196 when in the deployed position and is configured for inserting into an associated mounting hole of the pair of mounting holes of the light emitter 80, thereby securing the light emitter 80 to the second end bracket 192, when in the deployed position.

In use, the sidewall post 24 is received into the channel 22 of the sidewall bracket 12 and coupled to the sidewall bracket 12 via the plurality of threaded fasteners 52. Then each sidewall rail 40 is aligned in abutment with an associated sidewall wing member 16 and coupled to the associated sidewall wing member 16 via the plurality of threaded fasteners 52, thereby facilitating the alignment of the two adjacent sidewall portions 48 of the fence 46. The corner post 92 is positioned in abutment with the corner bracket 82 and coupled to the corner bracket 82 via the plurality of threaded fasteners 52. Then each corner rail 124 is aligned in abutment with an associated corner wing member 106 and coupled to the associated corner wing member 106 via the plurality of threaded fasteners 52, thereby facilitating the positioning of the first corner portion 138 of the fence 46 perpendicular to the second corner portion 140 of the fence 46. One of the first end bracket 160 or the second end bracket 192 is coupled to the first end 178 or the second end 180 respectively of the end rail 174 such that the light emitter 80 can be mounted on the first end bracket 160 or the second end bracket 192 and face laterally away from the end rail 174.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fence bracket kit comprising:

a sidewall bracket, said sidewall bracket comprising:

a central member, said central member being U-shaped, said central member having a pair of side portions and a front portion extending between said pair of side portions of said central member, said central member defining a channel between said pair of side portions of said central member and adjacent said front portion of said central member, said central member being configured for laterally receiving a sidewall post within said channel; and a pair of sidewall wing members, each said sidewall wing member being coupled to and extending from an associated side portion of said pair of side portions of said central member away from said channel, each said sidewall wing member being L-shaped, each said sidewall wing member having a bottom portion extending from said associated side portion of said central member, each said sidewall wing member having a front portion extending from said bottom portion of said sidewall wing member, each said sidewall wing member being configured for aligning an associated sidewall rail of a pair of sidewall rails such that each of a pair of sides of the associated sidewall rail abuts an associated one of each of said bottom portion of said sidewall wing member and said front portion of said sidewall wing member and an end of the associated sidewall rail abuts said associated side portion of said central member, said pair of sidewall wing members being configured for aligning the pair of sidewall rails with each said other to facilitate aligning two adjacent portions of a fence during construction of the fence;

a corner bracket, said corner bracket comprising:

a corner member, said corner member being L-shaped, said corner member having a pair of corner portions, a first corner portion of said pair of corner portions extending from a second corner portion of said pair of corner portions, said corner member being configured for abutting a corner of a corner post such that each said corner portion abuts an associated side of a plurality of sides of the corner post; and a pair of corner wing members, each said corner wing member extending from an associated corner portion of said pair of corner portions, each said corner wing member being L-shaped, each said wing member having a bottom portion extending from said associated corner portion, each said corner wing member having a front portion extending from said bottom portion, each said corner wing member being configured for aligning an associated corner rail of a pair of corner rails such that each of a pair of sides of the associated corner rail abuts an associated one of each of said bottom portion of each said corner wing member and said front portion of each said corner wing member and an end of the associated corner rail abuts each said corner portion;

a first end bracket, said first end bracket comprising:

a first base portion, said first base portion having a front edge and a side edge adjacent to said front edge of said first base portion;

a first front flange, said first front flange extending from said front edge of said first base portion; and a first side flange, said first side flange extending from said side edge of said first base portion, said first end bracket being configured for aligning an end rail such that each of a pair of sides of the end rail abuts an associated one of each of said first base portion and said first front flange and a first end of the end rail abuts said first side flange; and a second end bracket, said second end bracket comprising:

a second base portion, said second base portion having a front edge and a side edge adjacent to said front edge of said second base portion;

a second front flange, said second front flange extending from said front edge of said second base portion; and a second side flange, said second side flange extending from said side edge of said second base portion, said second end bracket being configured for aligning the end rail such that each of the pair of sides of the end rail abuts an associated one of each of said second base portion and said second front flange and a second end of the end rail abuts said second side flange.

2. The device of claim 1, further comprising:

each of said front portion of said central member and each said side portion of said central member being planar;

each of said bottom portion of each said sidewall wing member and said front portion of each said sidewall wing member being planar;

each said corner portion of said corner member being planar;

each of said bottom portion of each said corner wing member and said front portion of each said corner wing member being planar;

each of said first base portion, said first front flange, and said first side flange being planar; and each of said second base portion, said second front flange, and said second side flange being planar.

3. The device of claim 2, further comprising:

each of said front portion of said central member and each said side portion of said central member being rectangular;

each of said bottom portion of each said sidewall wing member and said front portion of each said sidewall wing member being rectangular;

each said corner portion of said corner member being rectangular;

each of said bottom portion of each said corner wing member and said front portion of each said corner wing member being rectangular;

each of said first base portion, said first front flange, and said first side flange being rectangular; and each of said second base portion, said second front flange, and said second side flange being rectangular.

4. The device of claim 1, further comprising each said side portion of said central member having a top end and a bottom end, said front portion of said central member having a bottom end extending between said bottom end of each said side portion of said central member and a top end extending between said top end of each said side portion of said central member, said bottom portion of each said sidewall wing member extending from said bottom end of said associated side portion of said central member, said front portion of each said sidewall wing member aligning with said front portion of said central member.

5. The device of claim 1, further comprising said first corner portion having a top end and a bottom end, said second corner portion having a top end extending from said top end of said first corner portion and a bottom end extending from said bottom end of said first corner portion, said bottom portion of said first corner wing member extending from said bottom end of said first corner portion, said front portion of said first corner wing member aligning with said second corner portion, said bottom portion of said second corner wing member extending from said bottom end of said second corner portion, said front portion of said second corner wing member aligning with said first corner portion.

6. The device of claim 1, further comprising said sidewall bracket further comprising:

a pair of front central holes, said pair of front central holes extending through said front portion of said central member, each said front central hole being configured for facilitating coupling said central member to the sidewall post by receiving an associated threaded fastener of a plurality of threaded fasteners therethrough;

a pair of first side holes, said pair of first side holes extending through a first side portion of said pair of side portions of said central member, each said first side hole being configured for facilitating coupling said central member to the sidewall post by receiving an associated threaded fastener of the plurality of threaded fasteners therethrough;

a pair of second side holes, said pair of second side holes extending through a second side portion of said pair of side portions of said central member, each said second side hole being configured for facilitating coupling said central member to the sidewall post by receiving an associated threaded fastener of the plurality of threaded fasteners therethrough;

a pair of first sidewall wing holes, said pair of first sidewall wing holes extending through said bottom portion of a first sidewall wing member of said pair of sidewall wing members, each said first sidewall wing hole being configured for facilitating coupling said central member to the associated sidewall rail by receiving an associated threaded fastener of the plurality of threaded fasteners therethrough; and a pair of second sidewall wing holes, said pair of second sidewall wing holes extending through said bottom portion of a second sidewall wing member of said pair of sidewall wing members, each said second sidewall wing hole being configured for facilitating coupling said central member to the associated sidewall rail by receiving an associated threaded fastener of the plurality of threaded fasteners therethrough.

7. The device of claim 1, further comprising said corner bracket further comprising:

a plurality of first corner holes, said plurality of first corner holes extending through said first corner portion, each said first corner hole being configured for facilitating coupling said corner member to the corner post by receiving an associated threaded fastener of the plurality of threaded fasteners therethrough;

a plurality of second corner holes, said plurality of second corner holes extending through said second corner portion, each said second corner hole being configured for facilitating coupling said corner member to the corner post by receiving an associated threaded fastener of the plurality of threaded fasteners therethrough;

a pair of first corner wing holes, said pair of first corner wing holes extending through said bottom portion of a first corner wing member of said pair of corner wing members, each said first corner wing hole being configured for facilitating coupling said corner member to the first corner rail by receiving an associated threaded fastener of the plurality of threaded fasteners therethrough; and a pair of second corner wing holes, said pair of second corner wing holes extending through said bottom portion of a second corner wing member of said pair of corner wing members, each said second corner wing hole being configured for facilitating coupling said corner member to the second corner rail by receiving an associated threaded fastener of the plurality of threaded fasteners therethrough.

8. The device of claim 1, further comprising said first end bracket further comprising:

a pair of first front holes, said pair of first front holes extending through said first front flange, each said first front hole being configured for facilitating coupling said first end bracket to the end rail by receiving an associated threaded fastener of the plurality of threaded fasteners therethrough; and a pair of first side holes, said pair of first side holes extending through said first side flange, each said first side hole being configured for facilitating coupling said first end bracket to the first end of an end rail by receiving an associated threaded fastener of the plurality of threaded fasteners therethrough.

9. The device of claim 1, further comprising said second end bracket further comprising:

a pair of second front holes, said pair of second front holes extending through said second front flange, each said second front hole being configured for facilitating coupling said second end bracket to the end rail by receiving an associated threaded fastener of the plurality of threaded fasteners therethrough; and a pair of second side holes, said pair of second side holes extending through said second side flange, each said second side hole being configured for facilitating coupling said second end bracket to the second end of an end rail by receiving an associated threaded fastener of the plurality of threaded fasteners therethrough.

10. The device of claim 1, further comprising said sidewall bracket further comprising a pair of sidewall mounting tabs, each said sidewall mounting tab having a bulb portion and a neck portion, said neck portion coupling said bulb portion to said front portion of said central member, each said sidewall mounting tab being bendably movable between an undeployed position and a deployed position, each said sidewall mounting tab being coplanar with said front portion of said central member when in said undeployed position, each said sidewall mounting tab extending away from said channel when in said deployed position, each said sidewall mounting tab being configured for inserting into an associated mounting hole of a pair of mounting holes of a light emitter, thereby securing the light emitter to the sidewall bracket, when in said deployed position.

11. The device of claim 1, further comprising said corner bracket further comprising a pair of corner mounting tabs, each said corner mounting tab having a bulb portion and a neck portion, said neck portion of each said corner mounting tab coupling said bulb portion of each said corner mounting tab to said front portion of an associated corner wing member, each said corner mounting tab being bendably movable between an undeployed position and a deployed position, each said corner mounting tab being coplanar with said front portion of said associated corner wing member when in said undeployed position, each said corner mounting tab extending away from said associated corner wing member when in said deployed position, each said corner mounting tab being configured for inserting into an associated mounting hole of the pair of mounting holes of the light emitter, thereby securing the light emitter to the sidewall bracket, when in said deployed position.

12. The device of claim 1, further comprising:

said first end bracket further comprising:

a pair of first end mounting tabs, each said first end mounting tab having a bulb portion and a neck portion, said neck portion of each said first end mounting tab coupling said bulb portion of each said first end mounting tab to said first front flange, each said first end mounting tab being bendably movable between an undeployed position and a deployed position, each said first end mounting tab being coplanar with said first front flange when in said undeployed position, each said first end mounting tab extending away from said first front flange when in said deployed position, each said first end mounting tab being configured for inserting into an associated mounting hole of the pair of mounting holes of the light emitter, thereby securing the light emitter to the first end bracket, when in said deployed position; and said second end bracket further comprising:

a pair of second end mounting tabs, each said second end mounting tab having a bulb portion and a neck portion, said neck portion of each said second end mounting tab coupling said bulb portion of each said second end mounting tab to said second front flange, each said second end mounting tab being bendably movable between an undeployed position and a deployed position, each said second end mounting tab being coplanar with said second front flange when in said undeployed position, each said second end mounting tab extending away from said second front flange when in said deployed position, each said second end mounting tab being configured for inserting into an associated mounting hole of the pair of mounting holes of the light emitter, thereby securing the light emitter to the second end bracket, when in said deployed position.

13. A fence bracket kit comprising:

a sidewall bracket, said sidewall bracket comprising:

a central member, said central member being U-shaped, said central member having a pair of side portions and a front portion extending perpendicularly between said pair of side portions of said central member, said central member defining a channel between said pair of side portions of said central member and adjacent said front portion of said central member, each of said front portion of said central member and each said side portion of said central member being planar, each of said front portion of said central member and each said side portion of said central member being rectangular, said central member being configured for laterally receiving a sidewall post within said channel such that each of said front portion of said central member and each said side portion of said central member abut an associated side of a plurality of sides of the sidewall post, each said side portion of said central member having a top end and a bottom end, said front portion of said central member having a bottom end extending between said bottom end of each said side portion of said central member and a top end extending between said top end of each said side portion of said central member;

a pair of sidewall wing members, each said sidewall wing member being coupled to and extending perpendicularly from an associated side portion of said pair of side portions of said central member away from said channel, each said sidewall wing member being L-shaped, each said sidewall wing member having a bottom portion extending from said bottom end of said associated side portion of said central member, each said sidewall wing member having a front portion extending perpendicularly from said bottom portion of said sidewall wing member and aligning with said front portion of said central member, each of said bottom portion of each said sidewall wing member and said front portion of each said sidewall wing member being planar, each of said bottom portion of each said sidewall wing member and said front portion of each said sidewall wing member being rectangular, each said sidewall wing member being configured for aligning an associated sidewall rail of a pair of sidewall rails such that each of a pair of sides of the associated sidewall rail abuts an associated one of each of said bottom portion of said sidewall wing member and said front portion of said sidewall wing member and an end of the associated sidewall rail abuts said associated side portion of said central member, said pair of sidewall wing members being configured for aligning the pair of sidewall rails with each said other to facilitate aligning two adjacent portions of a fence during construction of the fence;

a pair of front central holes, said pair of front central holes extending through said front portion of said central member, said pair of front central holes being aligned parallel with said bottom end of said front portion of said central member, each said front central hole being configured for facilitating coupling said central member to the sidewall post by receiving an associated threaded fastener of a plurality of threaded fasteners therethrough;

a pair of first side holes, said pair of first side holes extending through a first side portion of said pair of side portions of said central member, one of said pair of first side holes being positioned closer to said top end of said first side portion of said central member and closer to said front portion of said central member than another of said pair of first side holes, each said first side hole being configured for facilitating coupling said central member to the sidewall post by receiving an associated threaded fastener of the plurality of threaded fasteners therethrough;

a pair of second side holes, said pair of second side holes extending through a second side portion of said pair of side portions of said central member, one of said pair of second side holes being positioned closer to said top end of said second side portion of said central member and closer to said front portion of said central member than another of said pair of second side holes, each said second side hole being configured for facilitating coupling said central member to the sidewall post by receiving an associated threaded fastener of the plurality of threaded fasteners therethrough;

a pair of first sidewall wing holes, said pair of first sidewall wing holes extending through said bottom portion of a first sidewall wing member of said pair of sidewall wing members, said pair of first sidewall wing holes being aligned perpendicular to said front portion of said first sidewall wing member, each said first sidewall wing hole being configured for facilitating coupling said central member to the associated sidewall rail by receiving an associated threaded fastener of the plurality of threaded fasteners therethrough;

a pair of second sidewall wing holes, said pair of second sidewall wing holes extending through said bottom portion of a second sidewall wing member of said pair of sidewall wing members, said pair of second sidewall wing holes being aligned perpendicular to said front portion of said second sidewall wing member, each said second sidewall wing hole being configured for facilitating coupling said central member to the associated sidewall rail by receiving an associated threaded fastener of the plurality of threaded fasteners therethrough; and a pair of sidewall mounting tabs, each said sidewall mounting tab having a bulb portion and a neck portion, said neck portion coupling said bulb portion to said front portion of said central member, each said sidewall mounting tab being bendably movable between an undeployed position and a deployed position, each said sidewall mounting tab being coplanar with said front portion of said central member when in said undeployed position, said bulb portion of each said sidewall mounting tab being positioned between said neck portion and said top end of said front portion of said central member when each said sidewall mounting tab is in said undeployed position, each said sidewall mounting tab extending away from said channel when in said deployed position, each said sidewall mounting tab being configured for inserting into an associated mounting hole of a pair of mounting holes of a light emitter, thereby securing the light emitter to the sidewall bracket, when in said deployed position;

a corner bracket, said corner bracket comprising:

a corner member, said corner member being L-shaped, said corner member having a pair of corner portions, a first corner portion of said pair of corner portions extending perpendicularly from a second corner portion of said pair of corner portions, said first corner portion of said corner member being equal in size and shape to said second corner portion, each said corner portion being planar, each said corner portion being rectangular, said corner member being configured for abutting a corner of a corner post such that each said corner portion abuts an associated side of a plurality of sides of the corner post, said first corner portion having a top end and a bottom end, said second corner portion having a top end extending perpendicularly from said top end of said first corner portion and a bottom end extending perpendicularly from said bottom end of said first corner portion;

a pair of corner wing members, each said corner wing member extending perpendicularly from an associated corner portion of said pair of corner portions, each said corner wing member being L-shaped, a first corner wing member of said pair of corner wing members having a bottom portion extending perpendicularly from said bottom end of said first corner portion, said first corner wing member having a front portion extending perpendicularly from said bottom portion of said first corner wing member, and aligning with said second corner portion, said front portion of said first corner wing member having a top end facing away from said bottom portion of said first corner wing member, a second corner wing member of said pair of corner wing members having a bottom portion extending perpendicularly from said bottom end of said second corner portion, said second corner wing member having a front portion extending perpendicularly from said bottom portion of said second corner wing member and aligning with said first corner portion, said front portion of said second corner wing member having a top end facing away from said bottom portion of said second corner wing member, said first corner wing member being configured for aligning a first corner rail of a pair of corner rails such that each of a pair of sides of the first corner rail abuts an associated one of each of said bottom portion of said first corner wing member and said front portion of said first corner wing member and an end of the first corner rail abuts said first corner portion, said second corner wing member being configured for aligning a second corner rail of a pair of corner rails such that each of a pair of sides of the second corner rail abuts an associated one of each of said bottom portion of said second corner wing member and said front portion of said second corner wing member and an end of the second corner rail abuts said second corner portion, said pair of corner wing members being configured for angling said second corner rail perpendicular to said first corner rail to facilitate angling a second corner portion of the fence perpendicular to a first corner portion of the fence during construction of the fence;

a plurality of first corner holes, said plurality of first corner holes extending through said first corner portion, said plurality of first corner holes being positioned to define a first rectangle, said first rectangular being concentric with said first corner portion, each said first corner hole being configured for facilitating coupling said corner member to the corner post by receiving an associated threaded fastener of the plurality of threaded fasteners therethrough;

a plurality of second corner holes, said plurality of second corner holes extending through said second corner portion, said plurality of second corner holes being positioned to define a second rectangle, said second rectangular being concentric with said second corner portion, each said second corner hole being configured for facilitating coupling said corner member to the corner post by receiving an associated threaded fastener of the plurality of threaded fasteners therethrough;

a pair of first corner wing holes, said pair of first corner wing holes extending through said bottom portion of the first corner wing member, said pair of first corner wing holes being aligned perpendicular to said front portion of said first corner wing member, each said first corner wing hole being configured for facilitating coupling said corner member to the first corner rail by receiving an associated threaded fastener of the plurality of threaded fasteners therethrough;

a pair of second corner wing holes, said pair of second corner wing holes extending through said bottom portion of the second corner wing member, said pair of second corner wing holes being aligned perpendicular to said front portion of said second corner wing member, each said second corner wing hole being configured for facilitating coupling said corner member to the second corner rail by receiving an associated threaded fastener of the plurality of threaded fasteners therethrough; and a pair of corner mounting tabs, each said corner mounting tab having a bulb portion and a neck portion, said neck portion of each said corner mounting tab coupling said bulb portion of each said corner mounting tab to said front portion of an associated corner wing member, each said corner mounting tab being bendably movable between an undeployed position and a deployed position, each said corner mounting tab being coplanar with said front portion of said associated corner wing member when in said undeployed position, said bulb portion of each said corner mounting tab being positioned between said neck portion and said top end of said front portion of said associated corner wing member when each said corner mounting tab is in said undeployed position, each said corner mounting tab extending away from said associated corner wing member when in said deployed position, each said corner mounting tab being configured for inserting into an associated mounting hole of the pair of mounting holes of the light emitter, thereby securing the light emitter to the sidewall bracket, when in said deployed position;

a first end bracket, said first end bracket comprising:

a first base portion, said first base portion having a front edge and a side edge adjacent to said front edge of said first base portion, said first base portion being planar, said first base portion being square;

a first front flange, said first front flange extending from said front edge of said first base portion, said first front flange having a top end facing away from said first base portion, said first front flange being planar, said first front flange being rectangular;

a first side flange, said first side flange extending from said side edge of said first base portion, said second front flange being planar, said second front flange being rectangular, said first end bracket being configured for aligning an end rail such that each of a pair of sides of the end rail abuts an associated one of each of said first base portion and said first front flange and a first end of the end rail abuts said first side flange;

a pair of first front holes, said pair of first front holes extending through said first front flange, one of said pair of first front holes being positioned farther from said first base portion and closer to said first side flange than another of said pair of first front holes, each said first front hole being configured for facilitating coupling said first end bracket to the end rail by receiving an associated threaded fastener of the plurality of threaded fasteners therethrough;

a pair of first side holes, said pair of first side holes extending through said first side flange, one of said pair of first side holes being positioned farther from said first base portion and farther from said first front flange than another of said pair of first side holes, each said first side hole being configured for facilitating coupling said first end bracket to the first end of an end rail by receiving an associated threaded fastener of the plurality of threaded fasteners therethrough; and a pair of first end mounting tabs, each said first end mounting tab having a bulb portion and a neck portion, said neck portion of each said first end mounting tab coupling said bulb portion of each said first end mounting tab to said first front flange, each said first end mounting tab being bendably movable between an undeployed position and a deployed position, each said first end mounting tab being coplanar with said first front flange when in said undeployed position, said bulb portion of each said first end mounting tab being positioned between said neck portion and said top end of said first front flange when each said first end mounting tab is in said undeployed position, each said first end mounting tab extending away from said first front flange when in said deployed position, each said first end mounting tab being configured for inserting into an associated mounting hole of the pair of mounting holes of the light emitter, thereby securing the light emitter to the first end bracket, when in said deployed position; and a second end bracket, said second end bracket comprising:

a second base portion, said second base portion having a front edge and a side edge adjacent to said front edge of said second base portion, said second base portion being planar, said second base portion being square;

a second front flange, said second front flange extending from said front edge of said second base portion, said second front flange having a top end facing away from said second base portion, said second front flange being planar, said second front flange being rectangular;

a second side flange, said second side flange extending from said side edge of said second base portion, said second front flange being planar, said second front flange being rectangular, said second end bracket being configured for aligning the end rail such that each of the pair of sides of the end rail abuts an associated one of each of said second base portion and said second front flange and a second end of the end rail abuts said second side flange;

a pair of second front holes, said pair of second front holes extending through said second front flange, one of said pair of second front holes being positioned farther from said second base portion and closer to said second side flange than another of said pair of second front holes, each said second front hole being configured for facilitating coupling said second end bracket to the end rail by receiving an associated threaded fastener of the plurality of threaded fasteners therethrough;

a pair of second side holes, said pair of second side holes extending through said second side flange, one of said pair of second side holes being positioned farther from said second base portion and farther from said second front flange than another of said pair of second side holes, each said second side hole being configured for facilitating coupling said second end bracket to the second end of an end rail by receiving an associated threaded fastener of the plurality of threaded fasteners therethrough; and a pair of second end mounting tabs, each said second end mounting tab having a bulb portion and a neck portion, said neck portion of each said second end mounting tab coupling said bulb portion of each said second end mounting tab to said second front flange, each said second end mounting tab being bendably movable between an undeployed position and a deployed position, each said second end mounting tab being coplanar with said second front flange when in said undeployed position, said bulb portion of each said second end mounting tab being positioned between said neck portion and said top end of said second front flange when each said second end mounting tab is in said undeployed position, each said second end mounting tab extending away from said second front flange when in said deployed position, each said second end mounting tab being configured for inserting into an associated mounting hole of the pair of mounting holes of the light emitter, thereby securing the light emitter to the second end bracket, when in said deployed position.

* * * * *